US006540556B1

(12) United States Patent
Fu

(10) Patent No.: US 6,540,556 B1
(45) Date of Patent: Apr. 1, 2003

(54) ELECTRIC CONNECTOR

(75) Inventor: Huang-Lung Fu, Taipei (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 10/015,744

(22) Filed: Dec. 17, 2001

(51) Int. Cl.[7] ..... H01R 13/648

(52) U.S. Cl. ..... 439/607; 607/439; 607/108; 607/353; 607/884

(58) Field of Search ..... 439/101, 108, 439/607, 608, 353, 357, 884

(56) References Cited

U.S. PATENT DOCUMENTS 4,390,231 A * 6/1983 Plyer et al. ..... 339/217
4,790,775 A * 12/1988 David ..... 439/579
5,176,538 A * 1/1993 Hansell, III et al. ..... 439/607
5,292,256 A * 3/1994 Brunker et al. ..... 439/108
5,417,590 A * 5/1995 Dechelette et al. ..... 439/607
6,171,150 B1 * 1/2001 Saito et al. ..... 439/610
6,238,236 B1 * 5/2001 Craft, Jr. ..... 439/425

* cited by examiner

*Primary Examiner*—P. Austin Bradley
*Assistant Examiner*—Truc Nguyen
(74) *Attorney, Agent, or Firm*—Rabin & Berdo, P.C.

(57) ABSTRACT

An electric connector having an electrically insulative housing, terminals respectively mounted in respective terminal chambers of the housing, and a metal shielding shell covering the housing. The housing has locating notches. The terminals include signal transmission terminals and grounding terminals, each having a protruded positioning portion. The grounding terminals have the respective protruded positioning portions respectively engaged into the locating notches of the housing and maintained in contact with the metal shielding shell positively, forming with the metal shielding shell a grounding loop.

7 Claims, 7 Drawing Sheets

ELECTRIC CONNECTOR

BACKGROUND OF THE INVENTION

1. Field of the Invention

The present invention relates to an electric connector and, more particularly, to such an electric connector, in which the terminals include signal transmission terminals and grounding terminals, the grounding terminals each having a protruding positioning portion engaged into a respective locating notch in the electrically insulative housing and maintained in contact with the metal shielding shell and forming with the metal shielding shell a grounding loop.

2. Description of the Related Art

During signal transmission of an electric connector, signal interference may occur. The interference may come from the internal static noises or external electromagnetic noises. In order to eliminate this problem, electric connectors with EMI protective metal shielding shell are developed. FIG. 9 shows an electric connector according to the prior art. This structure of electric connector comprises a housing B defining a plurality of terminal slots B1, a plurality of terminals A respectively mounted in the terminal slots B1 and adapted for receiving respective terminals C of a matching connector, and a metal shielding shell (not shown) covered on the housing B. The terminals A each comprise a base A1, a rear mounting tail A2 backwardly extended from the base A1 and adapted for fastening to a circuit board (not shown) outside the housing B, and a cylindrical front receiving portion A3 forwardly extended from the base A1 and adapted for receiving the corresponding terminal C of the matching connector. Further, after installation of the metal shielding shell, electric wires are used and soldered to the metal shielding shell and grounding terminals selected from the terminals A, enabling the metal shielding shell and the grounding terminals to form a grounding loop. This grounding arrangement complicates the fabrication procedure of the electric connector. Further, improper soldering of the electric wires to the grounding terminals may cause a false grounding.

BACKGROUND OF THE INVENTION

The present invention has been accomplished to provide an electric connector, which eliminates the aforesaid problems. According to the present invention, the electric connector comprises an electrically insulative housing, the housing comprising a plurality of terminal chambers, a plurality of insertion holes respectively disposed in communication and alignment with the terminal chambers, and locating notches disposed in communication with a number of the terminal chambers, a plurality of terminals respectively mounted in the terminal chambers, the terminals each having a protruded positioning portion, and a metal shielding shell covered on the housing. The terminals include signal transmission terminals and grounding terminals. The protruded positioning portions of the signal transmission terminals are respectively stopped at the inside walls of the corresponding terminal chambers. The protruded positioning portions of the grounding terminals are respectively engaged into the locating notches of the housing and maintained in contact with the metal shielding shell, enabling the grounding terminals form with the metal shielding shell a grounding loop.

DETAILED DESCRIPTION OF THE PREFERRED EMBODIMENT

Figure 1:
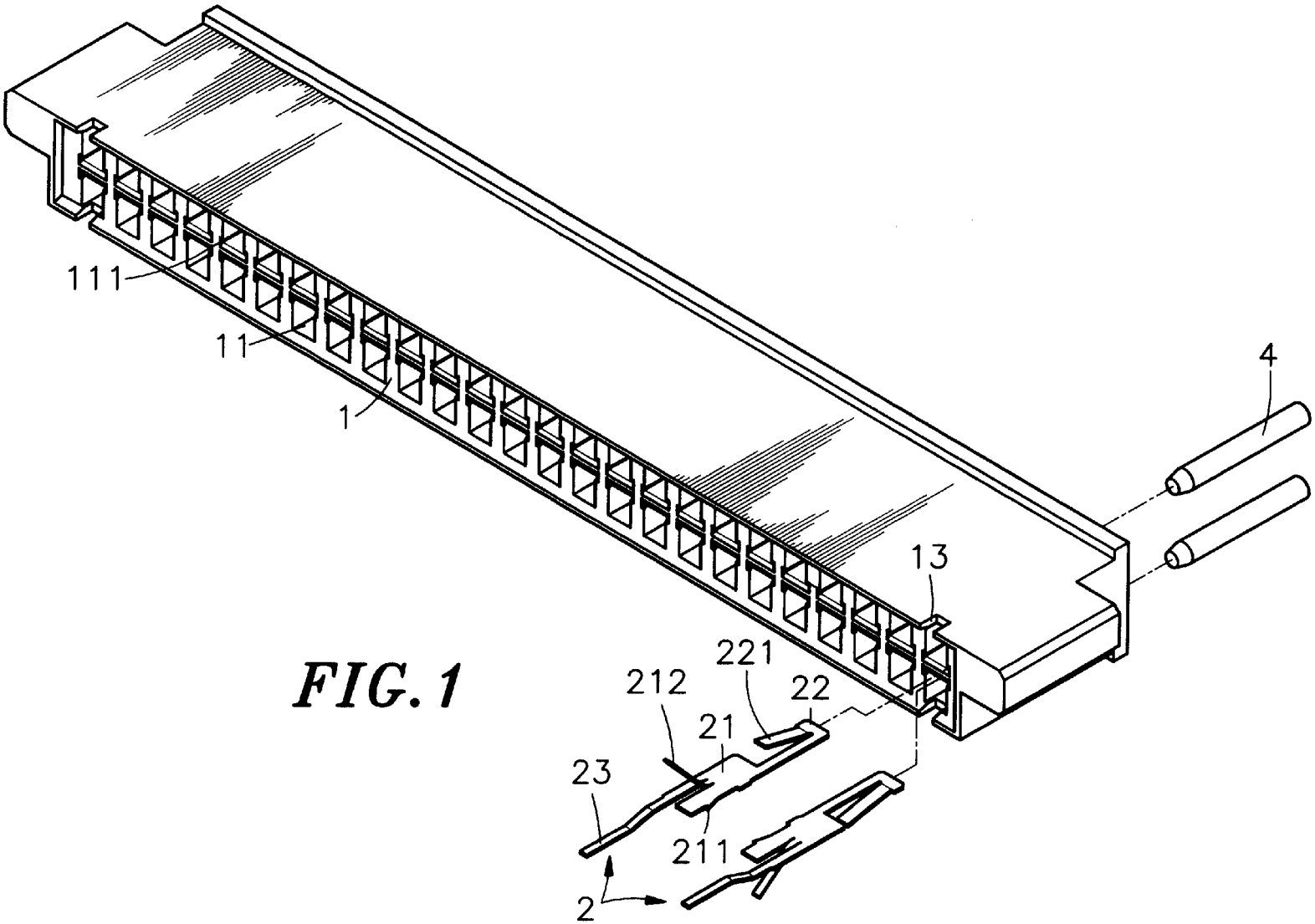
FIG. 1 is an exploded view of an electric connector constructed according to the present invention.
Figure 2:
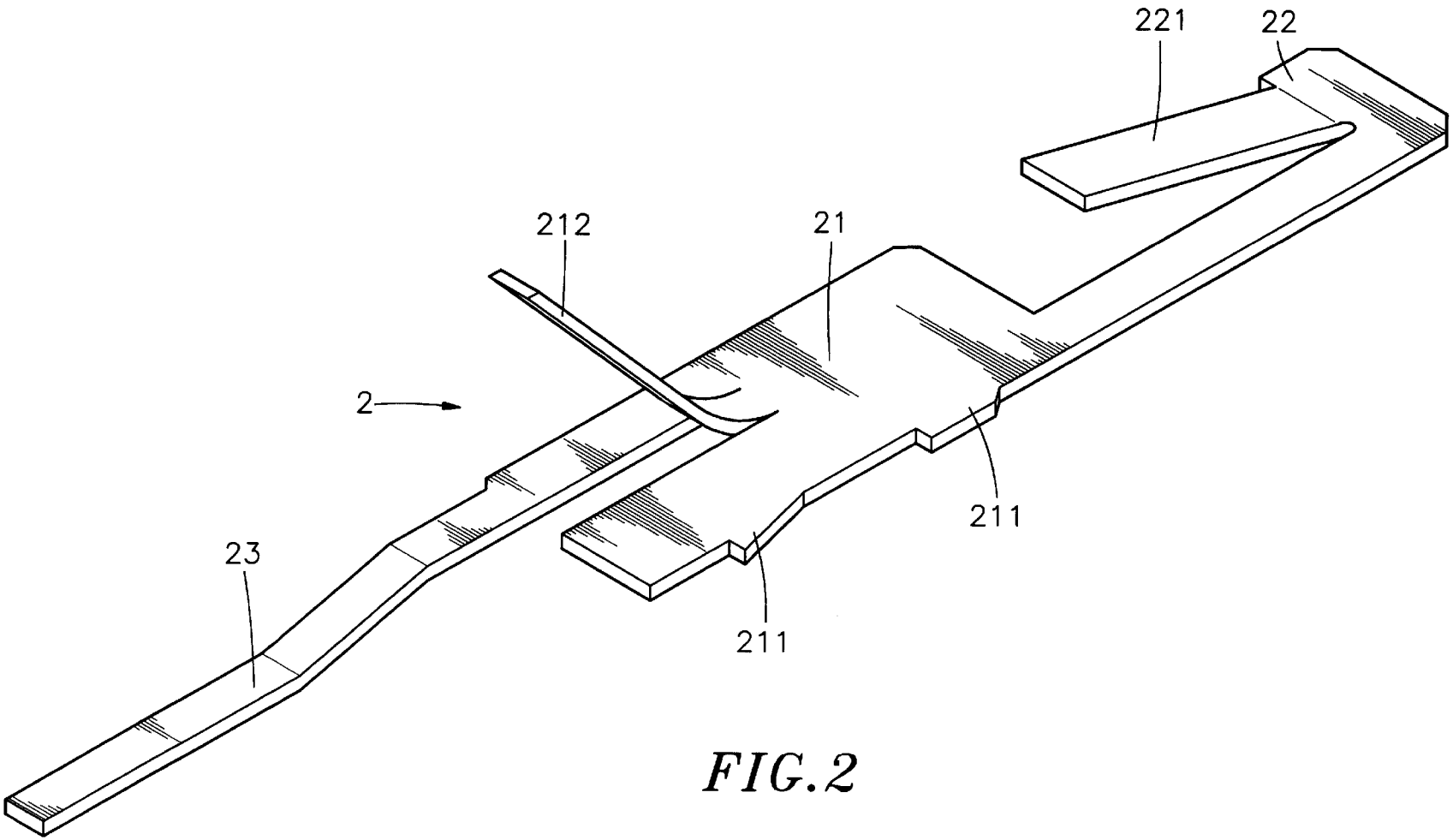
FIG. 2 is an elevational view of a terminal for the electric connector according to the present invention.
Figure 3:
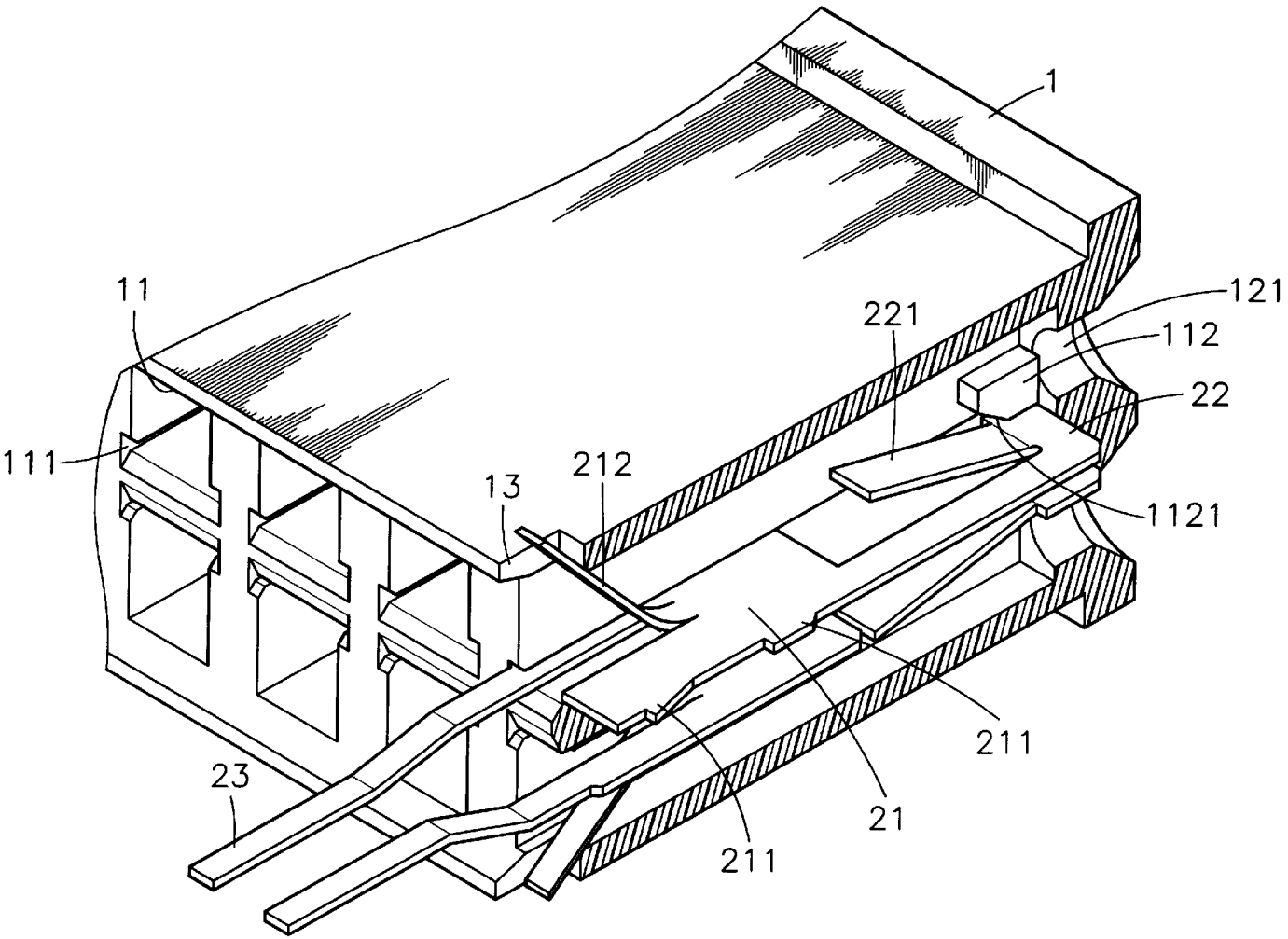
FIG. 3 is a sectional elevation of a part of the present invention, showing the positioning of the terminals in the terminal chambers of the housing.

Referring to FIGS. 1, 2, 3, and 8, an electric connector in accordance with the present invention is shown comprised of an electrically insulative housing 1, metal terminals 2, and a metal shielding shell 3.

The housing 1 comprises rows of terminal chambers 11 extended through the rear sidewall thereof, pairs of positioning grooves 111 respectively axially disposed in the terminal chambers 11 at two opposite lateral sides, a front receiving side 12 adapted for receiving a matching plug connector, rows of insertion holes 121 extended through the front receiving side 12 and respectively disposed in communication and axial alignment with the terminal chambers 11, and a plurality of protruding blocks 112 respectively disposed in the terminal chambers 11 adjacent the insertion holes 121. The protruding blocks 112 each have a beveled bottom guide edge 1121. Further, the housing 1 has a plurality of locating notches 13 respectively disposed near two opposite lateral sides thereof and in communication with the terminal chambers 11 two sides.

The terminals 2 are respectively mounted in the terminal chambers 11 of the housing 1, each comprising a flat base 21, an angled front locating portion 22 forwardly extended from the front side of the flat base 21, a springy contact portion 221 backwardly upwardly extended from a transversely extended front part of the angled front locating portion 22, a plurality of barbed portions 211 respectively protruded from the two opposite lateral sides of the flat base 21, a protruding positioning portion 212 backwardly upwardly extended from a middle part of the rear side of the flat base 21, and a mounting tail 23 horizontally backwardly extended from the rear side of the flat base 21.

The metal shielding shell 3 is fastened to the housing 1 and covered on the outside wall of the housing 1, keeping the terminal chambers 11 and the insertion holes 121 exposed to the outside.

Figure 4:
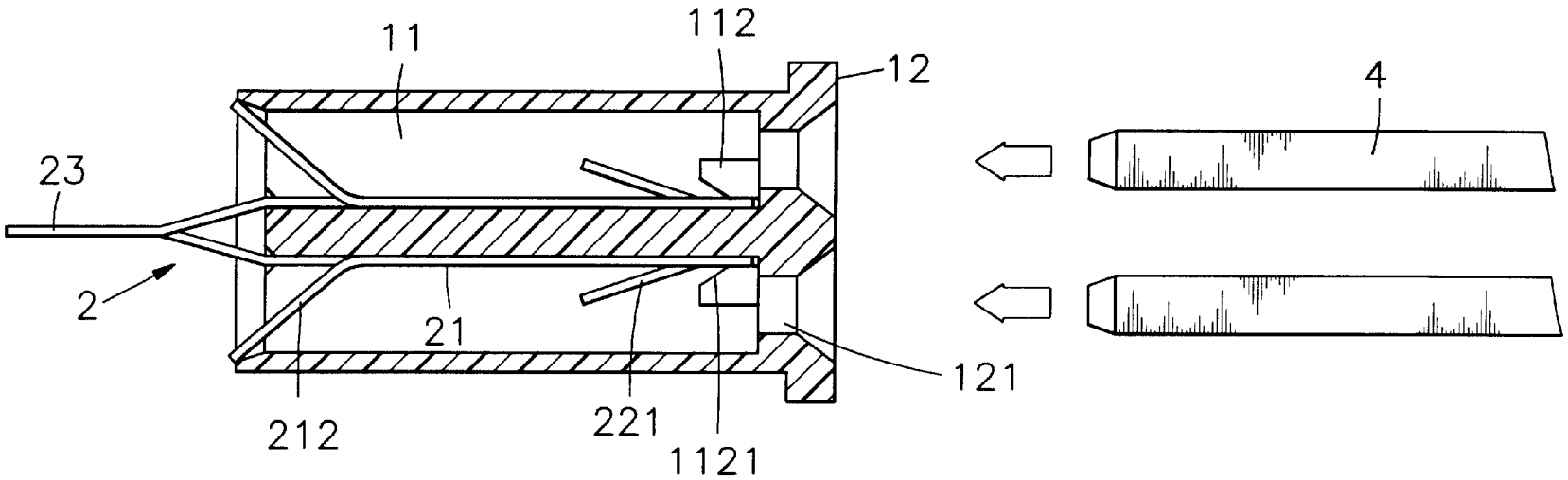
FIG. 4 is a sectional view of the present invention before insertion of the terminals of the matching plug connector.
Figure 6:
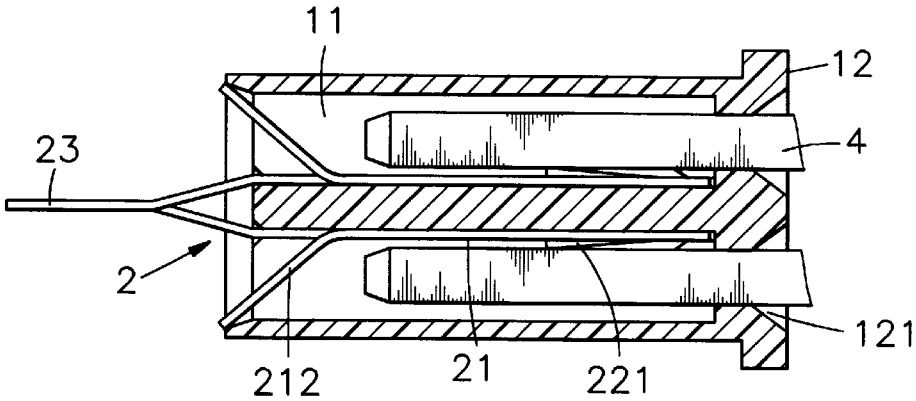
FIG. 6 is similar to FIG. 5 but showing the status where the terminals of the matching plug connector completely inserted into the insertion holes.
Figure 7:
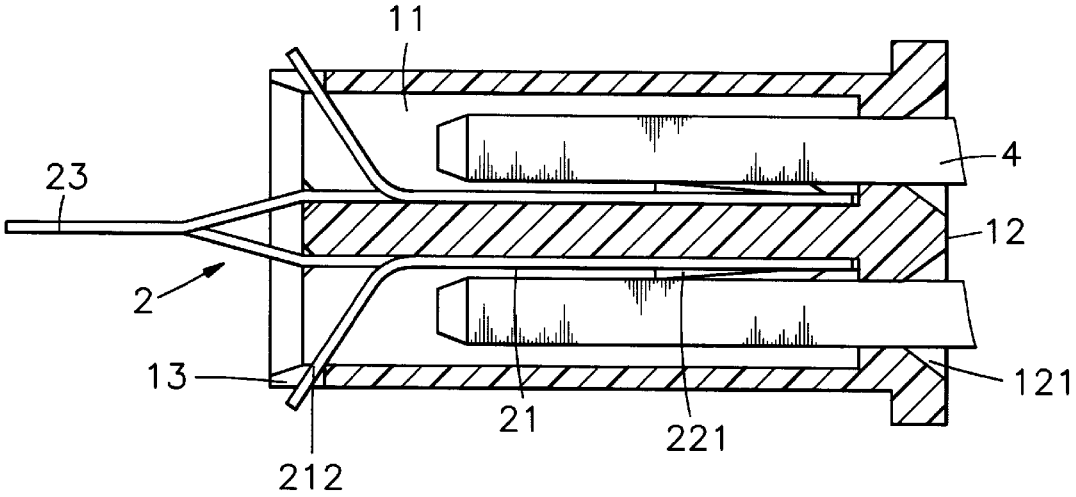
FIG. 7 is a sectional view of the present invention showing the protruded positioning portions of the terminals engaged into the locating notches of the housing before installation of the metal shielding shell.
Figure 8:
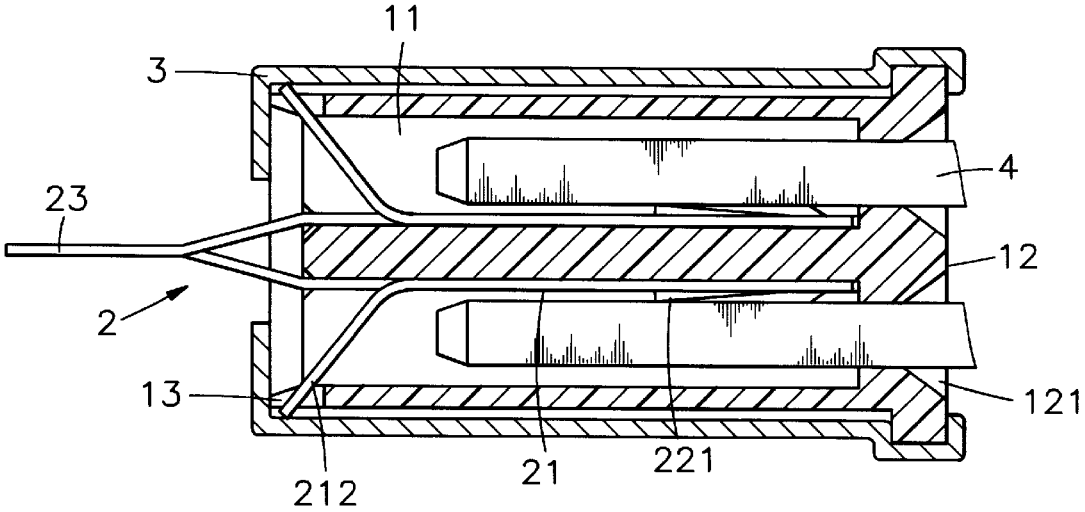
FIG. 8 is a sectional view of the present invention after installation of the metal shielding shell in the housing.
Figure 9:
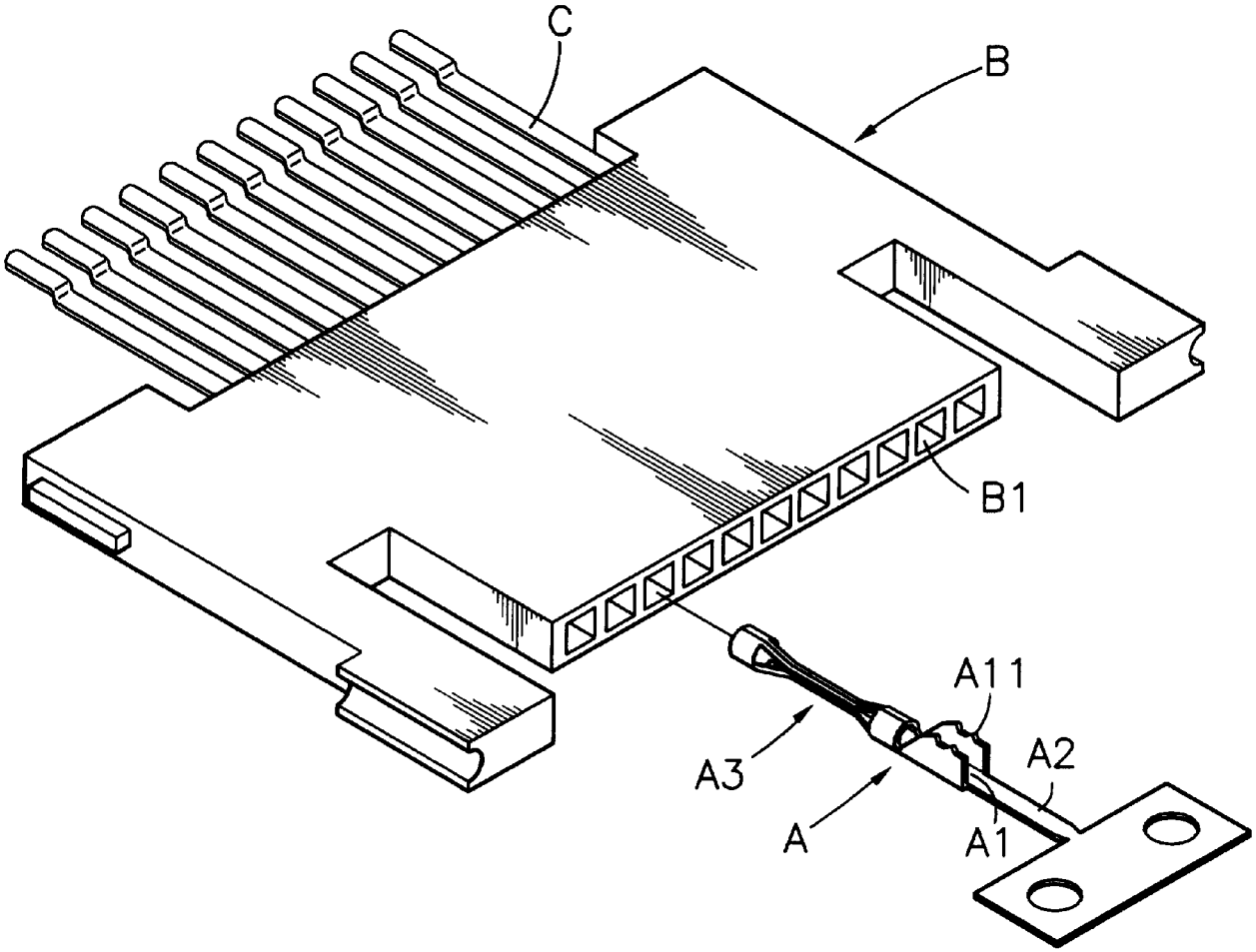
PRIOR ART FIG. 9
FIG. 9 is an exploded view of an electric connector constructed according to the prior art.

The assembly process of the electric connector is outlined hereinafter. The terminals 2 are respectively inserted into the terminal chambers 11 of the housing 1 to force the barbed portions 211 into engagement with the positioning grooves 111 in the terminal chambers 11. When set into position, the angled front locating portion 22 of each terminal 2 is respectively guided by the beveled bottom guide edge 1121 of the protruding block 112 in each terminal chamber 11 into engagement with the gap between the protruding block 112 and the inside wall of the respective terminal chamber 11 (see FIGS. 3 and 4), the protruded positioning portion 212 of each terminal 2 is respectively stopped at the inside walls of the terminal chambers 11 (see FIG. 6) or engaged into the locating notches 13 of the housing 1 (see FIG. 7), and the mounting tail 23 of each terminal 2 is respectively extended out of the terminal chambers 11 of the housing 1. After installation of the metal shielding shell 3, the terminals 2 having the respective protruded positioning portions 212 engaged into the locating notches 13 of the housing 1 are positively maintained in contact with the metal shielding shell 3 and forming with the metal shielding shell 3 a grounding loop (see FIG. 8); the terminals 2 having the respective protruded positioning portions 212 stopped against the inside wall of each of the terminal chambers 11 are provided for transmitting signal.

Figure 5:
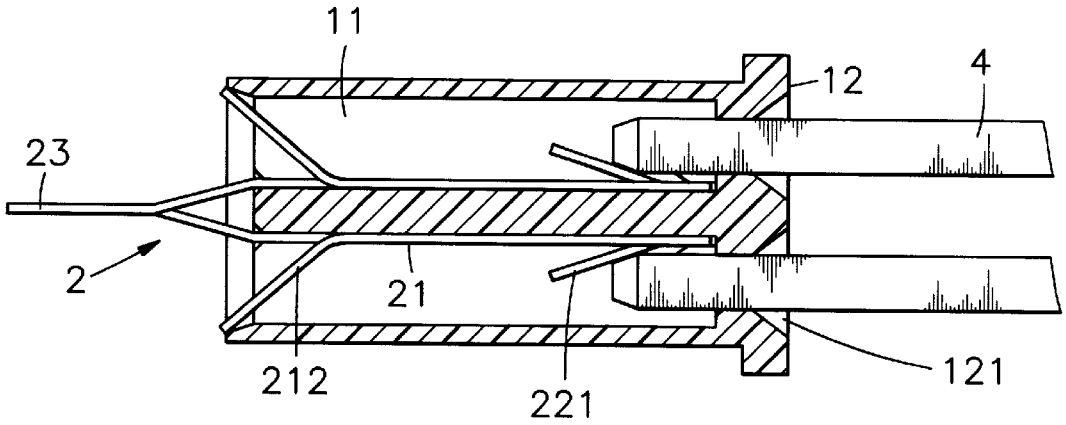
FIG. 5 is similar to FIG. 4 but showing the terminals of the matching plug connector partially inserted into the insertion holes of the housing of the connector according to the present invention.

Referring to FIGS. from 4 through 7, when in use, the mounting tails 23 of the terminals 2 are respectively soldered to respective contacts at a circuit board (not shown) for receiving a matching plug connector. After insertion of the terminals 4 of the matching plug connector into the insertion holes 121 of the housing 1 (see FIG. 5), the terminals 4 of the matching plug connector force the springy contact portions 221 of the terminals 2 inwards, and therefore the springy contact portions 221 of the terminals 2 are maintained in contact with the terminals 4 of the matching plug connector positively (see FIGS. 6 and 7).

In the aforesaid preferred embodiment of the present invention, the housing 1 has two rows of terminal chambers 11 and two rows of insertion holes 121 corresponding to the terminal chambers 11. In actual practice, the number of the terminal chambers 11 and the insertion holes 121 and their arrangement may be changed subject to actual requirement.

A prototype of electric connector has been constructed with the features of the annexed drawings of FIGS. 1~8. The electric connector functions smoothly to provide all of the features discussed earlier.

Although particular embodiment of the invention have been described in detail for purposes of illustration, various modifications and enhancements may be made without departing from the spirit and scope of the invention. Accordingly, the invention is not to be limited except as by the appended claims.

What the invention claimed is:

1. An electric connector, comprising:

an electrically insulative housing, said housing comprising a plurality of terminal chamber, and a plurality of insertion holes respectively disposed in communication and alignment with said terminal chambers, said housing further having at least one locating notch disposed in communication with at least one terminal chamber at an end remote from the insertion holes;

a plurality of substantially identically configured terminals, each being mountable within a respective one of said terminal chambers, said identically configured terminals including at least a first terminal that serves as a signal terminal, and at least a second terminal that serves as a grounding terminal, said identically configured terminals each comprising a flat base, and a protruded positioning portion backwardly upwardly extending from a middle part of a rear side of the flat base, wherein said second terminal is positionable in the terminal chamber having the locating notch in communication therewith, so that the protruded positioning portion of said second terminal extends from the locating notch; and wherein said first terminal is positionable in a terminal chamber not having a locating notch in communication therewith; and a metal shielding shell covering said housing, and engaging with the protruded positioning portion that extends from the locating notch of said second terminal to form a grounding loop.

2. The electric connector as claimed in claim 1, wherein said protruded positioning portion of said first terminal is stopped at an inside wall of the corresponding terminal chamber.

3. The electric connector as claimed in claim 2, wherein said identically configured terminals each comprises an angled front locating portion forwardly extending from a front side of the respective flat base, and a springy contact portion backwardly upwardly extending from a transversely extended front part of said angled front locating portion and adapted for receiving a respective terminal of a matching plug connector.

4. The electric connector as claimed in claim 3, wherein said terminal chambers of said housing each comprises two longitudinal positioning grooves disposed at two opposite lateral sides, and said identically configured terminals each comprises a plurality of barbed portions respectively protruding from two opposite lateral sides of the respective flat base and respectively engaged into the positioning grooves in said terminal chambers.

5. The electric connector as claimed in claim 4, wherein said terminal chambers each comprises a protruding block defining an engagement gap adapted for receiving a front part of the respective angled front locating portion.

6. The electric connector as claimed in claim 5, wherein said protruding block has a beveled bottom guide edge adapted for guiding the front part of the angled front locating portion of the corresponding terminal into the corresponding engagement gap.

7. The electric connector as claimed in claim 1, wherein said housing has a front receiving side defining said insertion holes and adapted for receiving a matching electric plug connector.

* * * * *